US009936303B2

(12) United States Patent
Jiang et al.

(10) Patent No.: US 9,936,303 B2
(45) Date of Patent: Apr. 3, 2018

(54) MULTI-DIAPHRAGM SPEAKER

(71) Applicant: GOERTEK INC., WeiFang, ShanDong Province (CN)

(72) Inventors: Chao Jiang, WeiFang (CN); Jianbin Yang, WeiFang (CN); Zhi Li, WeiFang (CN)

(73) Assignee: GOERTEK INC., WeiFang, Shandong Province (CN)

( * ) Notice: Subject to any disclaimer, the term of this patent is extended or adjusted under 35 U.S.C. 154(b) by 0 days.

(21) Appl. No.: 15/114,051

(22) PCT Filed: May 22, 2014

(86) PCT No.: PCT/CN2014/078096

§ 371 (c)(1),
(2) Date: Jul. 25, 2016

(87) PCT Pub. No.: WO2015/109697

PCT Pub. Date: Jul. 30, 2015

(65) Prior Publication Data

US 2016/0345103 A1 Nov. 24, 2016

(30) Foreign Application Priority Data

Jan. 26, 2014 (CN) ..... 2014 1 0037738

(51) Int. Cl.
*H04R 25/00* (2006.01)
*H04R 9/06* (2006.01)
(Continued)

(52) U.S. Cl.
CPC ..... *H04R 9/063* (2013.01); *H04R 7/127* (2013.01); *H04R 7/18* (2013.01); *H04R 9/025* (2013.01); *H04R 11/02* (2013.01)

(58) Field of Classification Search
CPC ..... H04R 9/063; H04R 7/127; H04R 7/18; H04R 9/025
(Continued)

(56) References Cited

U.S. PATENT DOCUMENTS 3,636,278 A * 1/1972 Heil ..... H04R 7/14 381/163
4,039,044 A * 8/1977 Heil ..... H04R 1/02 181/144

(Continued)

FOREIGN PATENT DOCUMENTS

CN 1977564 A 6/2007
CN 101656906 A 2/2010

(Continued)

OTHER PUBLICATIONS

Office Action (4th) dated Jan. 22, 2017 by Chinese Patent Office for corresponding Chinese application 201410037738.5.

*Primary Examiner* — Sean H Nguyen
(74) *Attorney, Agent, or Firm* — Holzer Patel Drennan

(57) ABSTRACT

A multi-diaphragm speaker comprises at least four diaphragms, inner connecting rods, and outer connecting rods. The diaphragms located at odd-numbered positions are connected to the inner connecting rods via connecting points, and then the inner connecting rods are connected via the outer connecting rods, thus forming a first set of diaphragms. The diaphragms located at even-numbered positions are connected to the inner connecting rods via connecting points, and then the inner connecting points are connected via the outer connecting rods, thus forming a second set of diaphragms. The long rods and short rods of the inner connecting rods in the first set of diaphragms and in the second set of diaphragms are staggered. The present invention can implement connection of diaphragms without requiring penetration of the diaphragms, thus preventing occurrences of air leakage and poor sound quality, and enhancing sound effects of the speaker.

6 Claims, 2 Drawing Sheets

(51) Int. Cl.

| | |
|---|---|
| ***H04R 7/12*** | (2006.01) |
| ***H04R 7/18*** | (2006.01) |
| ***H04R 9/02*** | (2006.01) |
| ***H04R 11/02*** | (2006.01) |

(58) Field of Classification Search
USPC ..... 381/186
See application file for complete search history.

(56) References Cited

U.S. PATENT DOCUMENTS

| | | | | |
|---|---|---|---|---|
| 4,107,479 | A * | 8/1978 | Heil | H04R 1/34 181/155 |
| 2009/0190791 | A1 * | 7/2009 | Unruh | H04R 9/063 381/398 |
| 2012/0121112 | A1 | 5/2012 | Lin et al. | |

FOREIGN PATENT DOCUMENTS

| | | | |
|---|---|---|---|
| CN | 102469393 | A | 5/2012 |
| CN | 103297904 | A | 9/2013 |
| CN | 203301728 | U | 11/2013 |
| CN | 103781002 | A | 5/2014 |
| CN | 203708480 | U | 7/2014 |

* cited by examiner

MULTI-DIAPHRAGM SPEAKER

TECHNICAL FIELD

The present invention relates to the acoustoelectric technical field, more specifically, to a multi-diaphragm speaker.

BACKGROUND

As a common electroacoustic transducer for converting electric energy into acoustic energy, a speaker plays an important role in sound system. There is a wide range of speakers, wherein audio power enables cones or diaphragms vibrating and resonating with ambient air to generate sound through galvanomagnetic effect, piezoelectric effect or electrostatic effect. Consequently, thanks to speakers, people may enjoy splendid music.

A diaphragm, functioning as a sound production component, is required to be light enough to ensure the sound effects of the speaker. Meanwhile, in order to decrease the resonant frequency of the speaker and improve the sensitivity of the speaker, a plurality of diaphragms are utilized in one speaker, and the diaphragms are connected by connecting rods, thereby optimizing the effect of electroacoustic transducing. However, in the production process of the existing speaker, the connecting rods are required to penetrate the diaphragms, so that the respective diaphragms can be connected, which may inevitably cause leakage of air, and once air leaks, poor sound quality, such as distortion of sound or noise and the like, may appears, which further influences the sound effects of the speaker.

SUMMARY

In view of the above problems, an objective of the present invention is to provide a multi-diaphragm speaker to solve the problem, i.e., poor sound quality of the speaker due to air leakage.

The present invention provides a multi-diaphragm speaker which comprises at least four diaphragms, inner connecting rods, and outer connecting rods; wherein, connecting points are respectively provided on major axes of rigid domes of the diaphragms;

the inner connecting rods comprise long rods and short rods; wherein, diaphragms located at odd-numbered positions are connected with the inner connecting rods through the connecting points, and then the inner connecting rods connected with the diaphragms located at odd-numbered positions are connected through the outer connecting rods, thus forming a first group of diaphragms; wherein, long rod(s) and short rod(s) of the inner connecting rods in the first group of diaphragms are mutually staggered;

diaphragms located at even-numbered positions are connected with the inner connecting rods through the connecting points, and then the inner connecting rods connected with the diaphragms located at even-numbered positions are connected through the outer connecting rods, thus forming a second group of diaphragms; wherein, long rod(s) and short rod(s) of the inner connecting rods in the second group of diaphragms are mutually staggered.

Wherein, the speaker according to the present invention further comprises magnetic circuits, wherein, the first group of diaphragms and the second group of diaphragms respectively vibrate in a same direction driven by a corresponding magnetic circuit, and vibrating directions of the first group of diaphragms and the second group of diaphragms are opposite to each other.

Wherein, a number of the inner connecting rods is consistent with that of the diaphragms, and a number of inner connecting rod(s) connected with each diaphragm is one or one pair.

Wherein, when the number of the inner connecting rod(s) connected with one diaphragm is one, a number of the outer connecting rods is two; when the number of the inner connecting rod(s) connected with one diaphragm is one pair, a number of the outer connecting rods is two pairs.

Wherein, in the first group of diaphragms, each long rod of the inner connecting rods is connected with one diaphragm in a ¼~½ region of a major axis of a rigid dome of the diaphragm, and each short rod of the inner connecting rods is connected with one diaphragm in a 0~¼ region of a major axis of a rigid dome of the diaphragm.

Wherein, in the second group of diaphragms, each long rod of the inner connecting rods is connected with one diaphragm in a ¼~½ region of a major axis of a rigid dome of the diaphragm, and each short rod of the inner connecting rods is connected with one diaphragm in a 0~¼ region of a major axis of a rigid dome of the diaphragm.

Wherein, all diaphragms in the first group of diaphragms vibrate in a same direction, and all diaphragms in the second group of diaphragms vibrate in a same direction.

Wherein, all diaphragms in the first group of diaphragms vibrate in an opposite direction to all diaphragms in the second group of diaphragms.

By using the multi-diaphragm speaker according the present invention, the respective diaphragms are connected by the inner connecting rods, and then the inner connecting rods are connected by the outer connecting rods, thus the present invention can implement connection of the respective diaphragms without requiring penetration of the diaphragms, thereby preventing occurrences of air leakage and poor sound quality, and enhancing sound effects of the speaker.

In order to achieve the above and related objectives, one or more aspects of the present invention comprise the features detailed below and indicated particularly in the claims. Some exemplary aspects of the present invention are described in details by the description below and the accompanying drawings. However, these aspects only indicate some implementations of various implementations of the present invention. In addition, the present invention is intended to contain these aspects and the equivalents thereof.

BRIEF DESCRIPTION OF THE DRAWINGS

By referring to the descriptions in connection with the accompanying drawings and the contents of the claims, and with a full understanding of the present invention, other purposes and results of the present invention will be more clearly and easily understand. Wherein:

Figure 1:
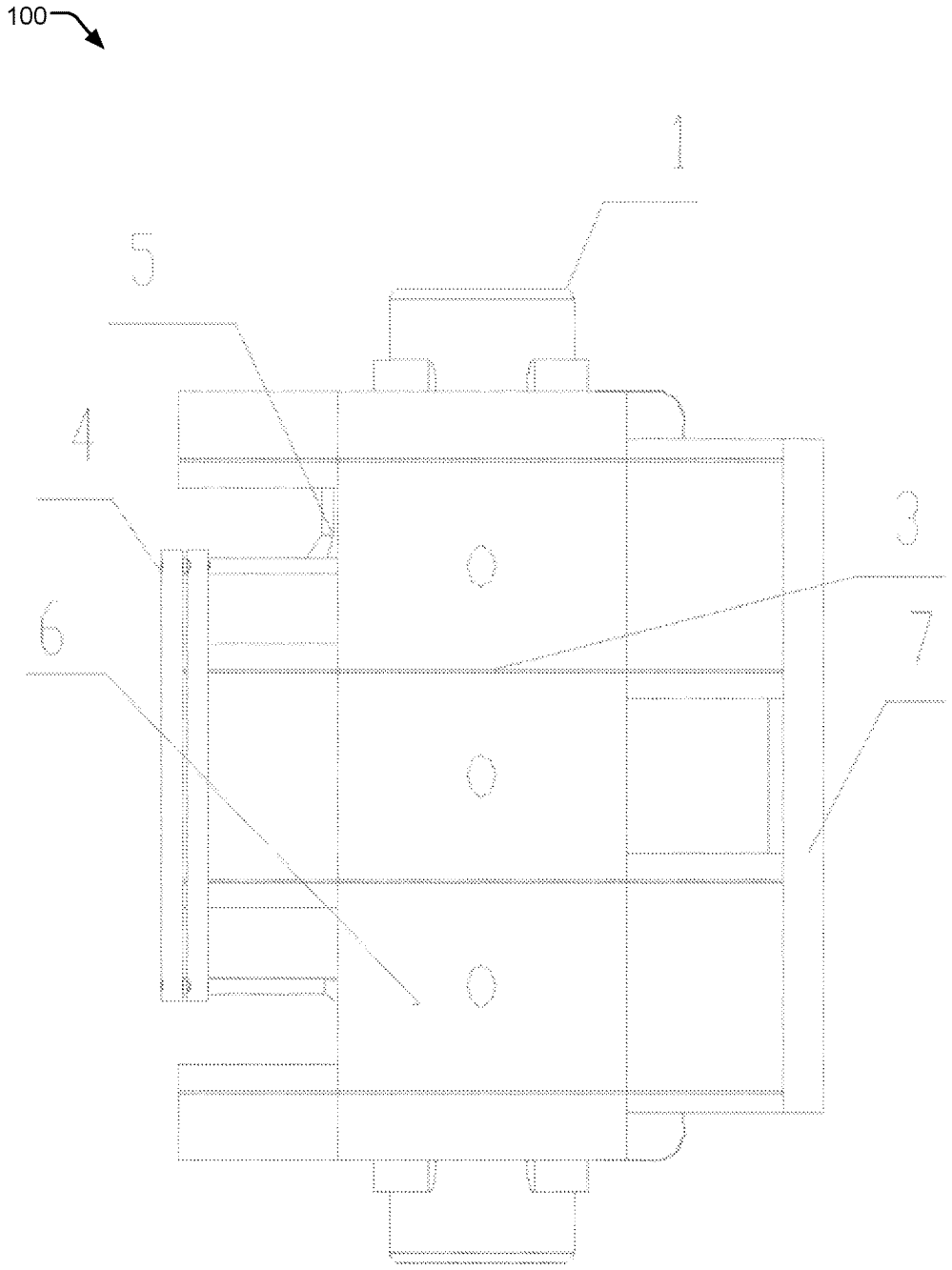
FIG. 1 is a front view of the planer structure of the multi-diaphragm speaker according to embodiments of the present invention.

In the figures: 1. magnetic circuit; 3. diaphragm; 4. outer connecting rod; 5. inner connecting rod; 6. housing; 7. front cavity sealing device; 21. first diaphragm; 22. second diaphragm; 23. third diaphragm; 24. fourth diaphragm; 25. long rod; 26. short rod; 27. connecting point.

Same reference numerals in all of the accompanying drawings indicate similar or corresponding features or functions.

DETAILED DESCRIPTIONS

Hereinafter, particular embodiments of the present invention are described in connection with the accompanying drawings.

In the production process of the existing speaker, the connecting rods are required to penetrate the diaphragms in order to implement connection of the diaphragms, thus incurring air leakage. In view of the above problem, in the present invention, the respective diaphragms are connected through the inner connecting rods, then the inner connecting rods are connected through the outer connecting rods, thus the present invention can implement connection of the respective diaphragms without requiring penetration of the diaphragms, thereby preventing occurrences of air leakage and poor sound quality, and enhancing sound effects of the speaker.

In order to explain the multi-diaphragm speaker provided by the present invention, FIG. 1 illustrates the plane structure of the multi-diaphragm speaker according to the embodiments of the present invention.

In the following descriptions, for sake of illustration, the rigid portion at the center of the diaphragm is referred to as rigid dome uniformly in the following description of the particular embodiments of the present invention.

As illustrated in FIG. 1, the multi-diaphragm speaker provided by the present invention comprises magnetic circuits 1, diaphragms 3, outer connecting rods 4, inner connecting rods 5, a housing 6 and a front cavity sealing device 7. Wherein, the diaphragms 3 are connected with the inner connecting rods 5 by providing connecting points on the major axes of rigid domes of the diaphragms 3, and then the respective diaphragms 3 connected with the inner connecting rods 5 are connected through the outer connecting rods 4. The magnetic circuits 1 drive the rigid domes of the diaphragms to make the diaphragms vibrate, so that the speaker may produce sound.

Typically, a plurality of diaphragms are utilized in one loudspeaker to enhance the radiation scope of the speaker, and thus the diaphragms located at the odd-numbered positions and the diaphragms located at the even-numbered positions are connected through the outer connecting rods 4 respectively, so as to constitute two groups of diaphragms, and the cavities formed between the individual diaphragms are covered by the housing 6 to achieve sealing. Meanwhile, as the outer connecting rods 4 are utilized in the speaker, the front cavity sealing device 7 is added to separate the front cavity and rear cavity of the speaker.

As the inner connecting rods 5 and the outer connecting rods 4 are utilized in the present invention, in the manufacturing process of the speaker, connection of the diaphragms 3 can be achieved without requiring penetration of the diaphragms 3, thereby preventing occurrences of air leakage and poor sound quality, improving sound effects of the speaker, and meanwhile, decreasing the difficulty for manufacturing the speaker as well.

The individual components of the multi-diaphragm speaker provided by the present invention and their connection relationships are described synoptically above, and the connection relationships of the individual components of the multi-diaphragm speaker provided by the present invention will be described in details below.

Particularly, the multi-diaphragm speaker provided by the present invention comprises diaphragms 3, inner connecting rods 5, and outer connecting rods 4; wherein, the number of the diaphragms 3 is at least four, connecting points are respectively provided on the major axes of rigid domes of the diaphragms 3; the inner connecting rods 5 comprise long rods and short rods; wherein, the diaphragms 3 located at odd-numbered positions are connected with the inner connecting rods 5 through the connecting points, and then the inner connecting rods 5 connected with the diaphragms 3 located at odd-numbered positions are connected through the outer connecting rods 4, thus forming a first group of diaphragms; wherein, the long rod(s) and short rod(s) of the inner connecting rods 5 in the first group of diaphragms are mutually staggered. That is, all the diaphragms 3, which connected with the inner connecting rods 5 and located at odd-numbered positions, are connected through the outer connecting rods 4, thus forming a first group of diaphragms; wherein, the long rod(s) and short rod(s) of the inner connecting rods 5 in the first group of diaphragms are mutually staggered.

The diaphragms 3 located at even-numbered positions are connected with the inner connecting rods 5 through the connecting points, and then the inner connecting rods 5 connected with the diaphragms 3 located at even-numbered positions are connected through the outer connecting rods 4, thus forming a second group of diaphragms; wherein, the long rod(s) and short rod(s) of the inner connecting rods 5 in the second group of diaphragms 3 are mutually staggered.

That is, all the diaphragms 3, which connected with the inner connecting rods 5 and located at even-numbered positions, are connected through the outer connecting rods 4, thus forming a second group of diaphragms; wherein, the long rod(s) and short rod(s) of the inner connecting rods 5 in the second group of diaphragms 3 are mutually staggered. As the speaker functions mainly based on the vibration of the diaphragms 3 to produce sound and the diaphragms 3 vibrate with certain amplitudes, in order to control the amplitudes of the diaphragms 3 when the diaphragms 3 vibrate, it can effectively suppress swing mode and bending vibration mode of the diaphragms 3 that the inner connecting rods 5 are placed at different positions of the rigid domes of the diaphragms 3. In the first and second groups of diaphragms, it is more conducive to suppress flexural vibration of the diaphragms that each of the long rods of the inner connecting rods 5 is connected with one diaphragm in a ¼~½ region of the major axis of rigid dome of the diaphragm 3, and each of the short rods of the inner connecting rods 5 is connected with one diaphragm in a 0~¼ region of the major axis of rigid dome of the diaphragm 3.

It should be noted that, the inner connecting rod(s) connected with one diaphragm 3 may be alone or paired, the alone or paired inner connecting rod(s) 5 correspond(s) to the diaphragms 3 in number. Meanwhile, the outer connecting rods 4 are mainly used for connecting the inner connecting rods 5, so as to connect all the diaphragms 3 in the whole speaker. Thus, the number of the outer connecting rods 4 is related to the number of the inner connecting rods 5, as well as the number of groups of the diaphragms 3.

That is, the number of the inner connecting rods 5 is consistent with that of the diaphragms 3 utilized in the whole speaker, and the number of the inner connecting rod(s) 5 connected with one diaphragm 3 is one or one pair. When the number of the inner connecting rod(s) 5 connected with one diaphragm 3 is one, the number of the outer connecting rods 4 is two; when the number of the inner connecting rod(s) 5 connected with one diaphragm 3 is one pair, the number of the outer connecting rods 4 is two pairs.

As an example, if six diaphragms 3 are utilized in one speaker, then the number of the inner connecting rods 5 may be 6, or 6 pairs. Meanwhile, as the outer connecting rods 4 is required to be connected with the long rods and short rods of the inner connecting rods 5, when the number of the inner connecting rod(s) 5 connected with one diaphragm 3 is one, the number of the outer connecting rods 4 is required to be two; when the number of the inner connecting rod(s) 5 connected with one diaphragm 3 is one pair, the outer connecting rods 4 are provided in pairs, and as there are two groups of diaphragms 3, the number of the outer connecting rods 4 is required to be two pairs. That is, the number of the outer connecting rods 4 is related to the number of the inner connecting rods 5, as well as the number of groups of the diaphragms 3. In the present invention, if the number of groups of the diaphragms 3 is two, the number of the outer connecting rods 4 is required to be two or two pairs correspondingly.

As a preferable embodiment of the present invention, the number of the inner connecting rod(s) 5 connected with one diaphragm is set to be one pair, which is more conducive to make the diaphragms 3 to be in an equilibrium state when the diaphragms 3 vibrate.

Additionally, the first group of diaphragms and the second group of diaphragms respectively vibrate in a same direction driven by the corresponding magnetic circuit 1, and vibrating directions of the first group of diaphragms and the second group of diaphragms are opposite to each other. Preferably, all the diaphragms 3 in the first group of diaphragms vibrate in a same direction, all the diaphragms 3 in the second group of diaphragms vibrate in a same direction, and all the diaphragms 3 in the first group of diaphragms 3 vibrate in an opposite direction to all the diaphragms 3 in the second group of diaphragms.

That is, all the diaphragms 3 in the first group of diaphragms vibrate in the same direction due to connection with the same group of outer connecting rods 4. For example, when the first group of diaphragms vibrate upward, the second group of diaphragms vibrate downward, and when the first group of diaphragms vibrate downward, the second group of diaphragms vibrate upward.

Figure 2:
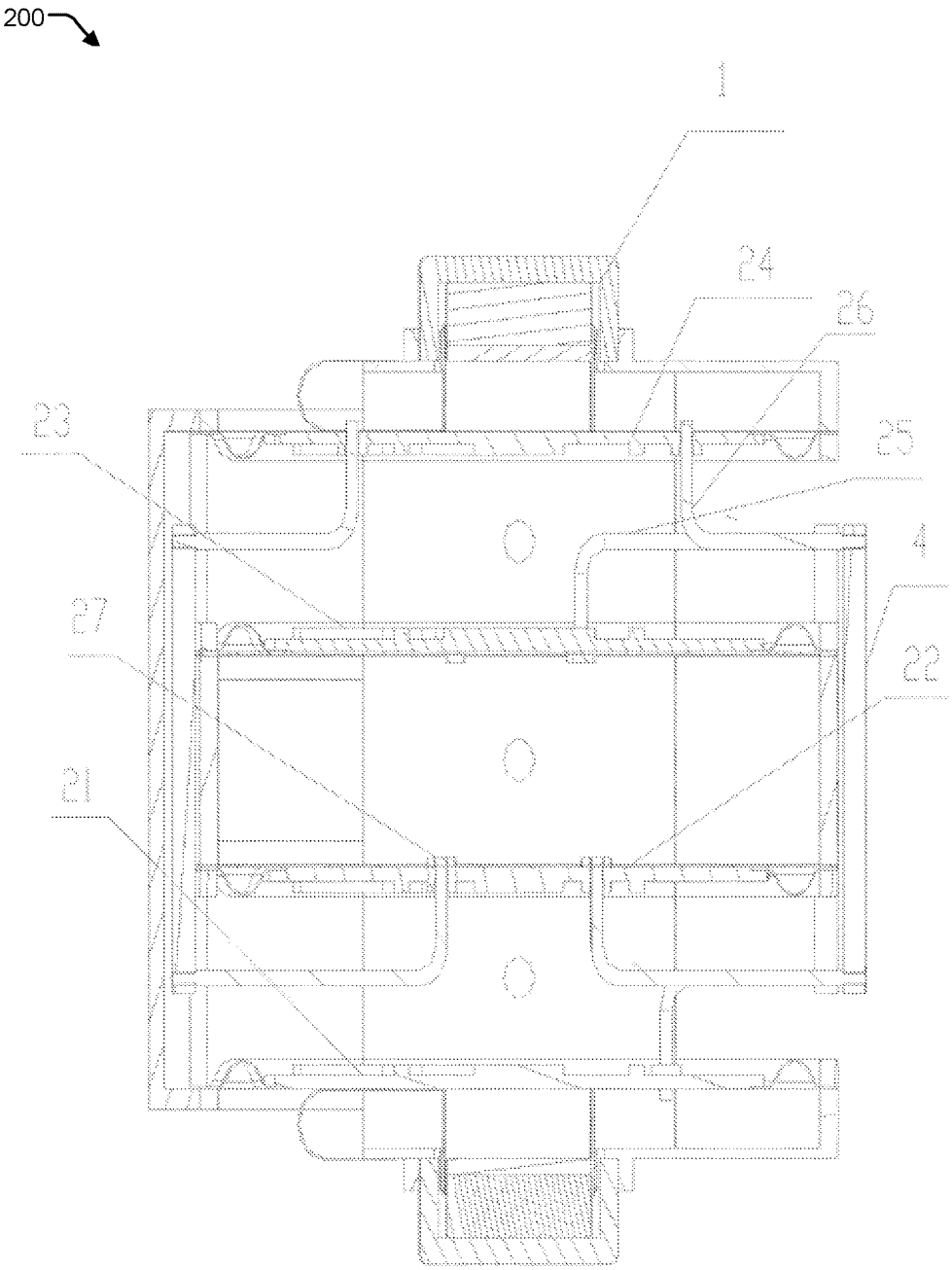
FIG. 2 is a schematic structure view showing the positions of the connecting rods of the multi-diaphragm speaker according to embodiments of the present invention.

In order to more specifically explain the connection relationships of individual diaphragms in the multi-diaphragm speaker provided by the present invention, FIG. 2 illustrates the locations and structures of the connecting rods in the multi-diaphragm speaker according to the embodiments of the present invention.

As illustrated in FIG. 2, the number of the diaphragms of the multi-diaphragm speaker provided by the present invention is at least four, and the diaphragms comprise a first diaphragm 21, a second diaphragm 22, a third diaphragm 23 and a fourth diaphragm 24. Connecting points are respectively provided on the major axes of rigid domes of the first diaphragm 21, the second diaphragm 22, the third diaphragm 23 and the fourth diaphragm 24. The inner connecting rods comprise long rods 25 and short rods 26. Wherein, the first diaphragm 21 is connected with the long rod(s) 25 through the connecting point(s) 27, the third diaphragm 23 is connected with the short rod(s) 26 through the connecting point(s) 27, and then the first diaphragm 21 and the third diaphragm 23 are connected through the outer connecting rod(s) 4, thus forming a first group of diaphragms.

The second diaphragm 22 is connected with the short rod(s) 26 through the connecting point(s) 27, the fourth diaphragm 24 is connected with the long rod(s) 25 through the connecting point(s) 27, and then the second diaphragm 22 and the fourth diaphragm 24 are connected through the outer connecting rod(s) 4, thus forming a second group of diaphragms.

Alternatively, the first diaphragm 21 is connected with the short rod(s) 26 through the connecting point(s) 27, the third diaphragm 23 is connected with the long rod(s) 25 through the connecting point(s) 27, and then the first diaphragm 21 and the third diaphragm 23 are connected through the outer connecting rod(s) 4, thus forming a first group of diaphragms.

The second diaphragm 22 is connected with the long rod(s) 25 through the connecting point(s) 27, the fourth diaphragm 24 is connected with the short rod(s) 26 through the connecting point(s) 27, and then the second diaphragm 22 and the fourth diaphragm 24 are connected through the outer connecting rod(s) 4, thus forming a second group of diaphragms. In that manner, the first group of diaphragms and the second group of diaphragms vibrate under the driving of the magnetic circuits 1, thereby make the speaker produce sound.

It can be seen from the above embodiment that the diaphragms located at odd-numbered positions form the first group of diaphragms through the inner connecting rods and the outer connecting rods, the diaphragms located at even-numbered positions form the second group of diaphragms through the inner connecting rods and the outer connecting rods, and the long rods and short rods of the inner connecting rods in the first group of diaphragms and in the second group of diaphragms are mutually staggered, and the long rods and short rods of the inner connecting rods in the starting diaphragms of the first group of diaphragms and the second group of diaphragms are mutually staggered as well.

In order to decrease the monomer resonant frequency of the diaphragms in the speaker and improve the tone quality and sensitivity of the whole speaker, a plurality of diaphragms may be utilized in one speaker, and the number of the diaphragms may be even, and may be odd as well. Only four diaphragms are taken as an example in the above embodiment. Similarly, more diaphragms can be utilized in one speaker to broaden the radiation scope of the speaker.

Specifically, speaker with six diaphragms are taken as an example below. For convenience of description, six diaphragms are respectively referred to as a first diaphragm, a second diaphragm, a third diaphragm, a fourth diaphragm, a fifth diaphragm and a sixth diaphragm herein. Wherein, connecting points are respectively provided on the major axes of rigid domes of the first diaphragm, the second diaphragm, the third diaphragm, the fourth diaphragm, the fifth diaphragm and the sixth diaphragm. The inner connecting rods comprise long rods and short rods. Wherein, the first diaphragm is connected with the long rod(s) through the connecting points, the third diaphragm is connected with the short rod(s) through the connecting points, and the fifth diaphragm is connected with the long rod(s) through the connecting points, and the then first diaphragm, the third diaphragm and the fifth diaphragm are connected through the outer connecting rod(s), thus forming a first group of diaphragms.

The second diaphragm is connected with the short rod(s) through the connecting points, the fourth diaphragm is connected with the long rod(s) through the connecting points, and the sixth diaphragm is connected with the short rod(s) through the connecting points, and then the second diaphragm, the fourth diaphragm and the sixth diaphragm are connected through the outer connecting rod(s), thus forming a second group of diaphragms.

As can be seen from the above, the respective diaphragms are connected with the inner connecting rods in the multi-diaphragm speaker provided by the present invention, and then the inner connecting rods are connected through the outer connecting rods, thus the present invention can implement connection of the respective diaphragms without requiring penetration of the diaphragms, thereby preventing occurrences of air leakage and poor sound quality, and enhancing sound effects of the speaker.

As described above, the multi-diaphragm speaker according to the present invention is described by way of example with reference to the accompanying drawings. However, it should be understood by those skilled in the art that various improvements can be made to the multi-diaphragm speaker provided by the present invention as described above without depart from the contents of the present invention. Accordingly, the scope of protection of the present invention is determined by the contents of the appended claims.

What is claimed is:

1. A multi-diaphragm speaker, comprising at least four diaphragms, inner connecting rods, and outer connecting rods; wherein, connecting points are respectively provided on major axes of rigid domes of the diaphragms;

the inner connecting rods comprise long rods and short rods; wherein, diaphragms located at odd-numbered positions are connected with the inner connecting rods through the connecting points, and then the inner connecting rods connected with the diaphragms located at the odd-numbered positions are connected through the outer connecting rods, thus forming a first group of diaphragms; wherein, long rods and short rods of the inner connecting rods in the first group of diaphragms are mutually staggered;

diaphragms located at even-numbered positions are connected with the inner connecting rods through the connecting points, and then the inner connecting rods connected with the diaphragms located at the even-numbered positions are connected through the outer connecting rods, thus forming a second group of diaphragms; wherein, long rods and short rods of the inner connecting rods in the second group of diaphragms are mutually staggered, in at least one of the first group of diaphragms and the second group of diaphragms, each long rod of the inner connecting rods is connected with one diaphragm in a region within ¼ to ½ of a length of a major axis of a rigid dome of the diaphragm, and each short rod of the inner connecting rods is connected with one diaphragm in a region within 0 to ¼ of the length of the major axis of the rigid dome of the diaphragm.

2. The multi-diaphragm speaker according to claim 1, further comprising magnetic circuits, wherein, the first group of diaphragms and the second group of diaphragms respectively vibrate in a same direction driven by a corresponding magnetic circuit, and vibrating directions of the first group of diaphragms and the second group of diaphragms are opposite to each other.

3. The multi-diaphragm speaker according to claim 2, wherein, all diaphragms in the first group of diaphragms vibrate in a same direction, and all diaphragms in the second group of diaphragms vibrate in a same direction.

4. The multi-diaphragm speaker according to claim 2, wherein, all diaphragms in the first group of diaphragms vibrate in an opposite direction to all diaphragms in the second group of diaphragms.

5. The multi-diaphragm speaker according to claim 1, wherein, a number of the inner connecting rods is consistent with a number of total diaphragms of the diaphragms located at the odd-numbered positions and the diaphragms located at the even-numbered positions, and the number of inner connecting rods connected with each diaphragm is one or one pair.

6. The multi-diaphragm speaker according to claim 5, wherein, when the number of the inner connecting rods connected with one diaphragm is one, a number of the outer connecting rods is two;

when the number of the inner connecting rods connected with one diaphragm is one pair, a number of the outer connecting rods is two pairs.

* * * * *